United States Patent [19]

Büchl

[11] Patent Number: 4,970,622

[45] Date of Patent: Nov. 13, 1990

[54] METHOD AND APPARATUS FOR CONTROLLING THE OPERATION OF AN ELECTROMAGNET

[76] Inventor: Josef Büchl, Rehsteig 12, D-8071 Lenting, Fed. Rep. of Germany

[21] Appl. No.: 189,018

[22] Filed: May 2, 1988

Related U.S. Application Data

[63] Continuation-in-part of Ser. No. 937,406, Dec. 3, 1986.

[51] Int. Cl.[5] ..... H01H 9/00

[52] U.S. Cl. ..... 361/154; 123/490

[58] Field of Search ..... 361/152, 153, 154, 159, 361/182; 123/490, 90.11, 494, 571

[56] References Cited

U.S. PATENT DOCUMENTS

| | | | |
|---|---|---|---|
| 4,123,729 | 10/1978 | Buetemeister | 123/494 |
| 4,544,986 | 10/1985 | Büchl | 361/152 |
| 4,823,825 | 4/1989 | Büchl | 361/152 |

FOREIGN PATENT DOCUMENTS

| | | |
|---|---|---|
| 2425585 | 2/1975 | Fed. Rep. of Germany . |
| 3326605 | 2/1985 | Fed. Rep. of Germany . |

*Primary Examiner*—L. T. Hix
*Assistant Examiner*—David M. Gray
*Attorney, Agent, or Firm*—Karl Hormann

[57] ABSTRACT

A method and apparatus for controlling the operation of an electromagnet by comparing the frequency of its holding current pulses against a reference frequency and by initiating another energization cycle if a difference exceeding a predetermined value is detected.

12 Claims, 2 Drawing Sheets

METHOD AND APPARATUS FOR CONTROLLING THE OPERATION OF AN ELECTROMAGNET

REFERENCE TO RELATED APPLICATIONS

The present application is a continuation-in-part of application Ser. No. 937,406, filed Dec. 3, 1986, and discloses subject matter generally related to applications Ser. Nos.: 855,896 filed Apr. 24, 1986, now abandoned, 856,032 filed Apr. 25, 1986, now abandoned, 937,408 filed Dec. 3, 1986 now abandoned, 019,242 filed Mar. 2, 1987, now U.S. Pat. No. 4,846,120 issued July 11, 1989 124,490 filed Nov. 23, 1987, now U.S. Pat. No. 4,885,658 issued Dec. 5, 1989 and 135,700 filed Dec. 21, 1987 now U.S. Pat. No. 4,823,825 issued Apr. 25, 1989; and U.S. Pat. No. 4,544,986, issued Oct. 1, 1985.

BACKGROUND OF THE INVENTION

1. Background of the Invention

The invention in general relates to controlling the operation of electromagnets and more particularly to the control of electromagnets useful for driving fuel intake or exhaust valves of internal combustion engines between their open and closed positions.

2. Description of the Prior Art

It is well known to utilize electromagnets for driving fuel intake and exhaust valves, hereinafter referred to as gas exchange valves, of internal combustion engines. As will be appreciated proper control of such electromagnets is tantamount to flawless functioning of the valves and engines.

A valve of the kind under consideration is normally held in a neutral position, i.e. a position intermediate its open and closed positions, by the bias of a pair of counteracting springs, and it may be driven into its open or closed position by electromagnets the armatures of which may be operatively connected to the valve. Driving such a valve into its open or closed position, hereinafter referred to as the terminal position, requires energization of the coil of the respective electromagnet with current of a level sufficiently high to pull or push, as the case may be, the armature into engagement with the stator. Once such engagement has taken place the current may be reduced to a level sufficient to maintain the engagement. Hereinafter it will be assumed that upon solenoid energization the armature is pulled into engagement with its stator.

Conventional methods of providing reduced level cycling current may utilize freewheeling circuits connected in parallel with the electromagnet. An arrangement of this kind is disclosed, for instance, by West German patent specification DE-OS 2425585.

Such devices suffer from an inherent problem: Their reduced level holding current phase must not be initiated until after the high level current energization phase has been successfully concluded by the attraction of the armature of the electromagnet into engagement with the stator; for while such reduced level holding current is sufficient for maintaining the armature in its engagement with the stator it is incapable of driving the armature there. Hence, premature initiation of the reduced current phase would prevent the armature from being pulled into engagement with the stator. This, in turn, would result in faulty valve and engine operation.

Circuits have become known which measure or monitor the increase in current during the energization or driving phase of electromagnetic coils and for detecting a temporary drop or break in the rising current slope as an indication of the engagement of the armature with the stator. However, such circuits have been found not to function with the degree of reliability absolutely necessary for flawless engine operation, for their functioning is strongly dependent upon the supply voltage, and they have been found to be particularly prone to malfunction at increases in the supply voltage.

West German patent specification DE-OS 33 26 605 teaches a circuit for monitoring the stroke position of an armature during an operational cycle of an electromagnet. This is accomplished by energizing the electromagnet with direct current with an alternating current superimposed there.

Since the inductance of the electromagnet differs depending upon whether or not the armature is in engagement with the stator, the value of the a.c. component differs correspondingly. Thus, by monitoring the value of the a.c. component the system aims at detecting engagement of the armature with the stator.

However, such a circuit is relatively complicated and requires precise and sophisticated current measuring methods.

It is, therefore, an object of the invention to provide a simple and effective method of and apparatus for detecting the position of an armature in a solenoid during its operation.

It is also an object of the invention to provide for a novel method and apparatus for detecting whether an armature has been attracted into engagement with its stator during an operational cycle of an electromagnet.

A particular object of the invention resides in comparing the frequency of current pulses cycling between upper and lower limits in a freewheeling circuit of an electromagnet during engagement of the armature with the stator against a reference frequency and to connect the electromagnet to a current source whenever a difference exceeding a predetermined value is detected.

A further object of the invention is to improve the performance of internal combustion engines with electromagnetically driven fuel intake and exhaust valves by monitoring their holding current pulses.

Other objects will in part be obvious and will in part appear hereinafter. The invention accordingly comprises a mechanism and system possessing the construction, combination of elements and arrangements of parts which are exemplified in the detailed disclosure.

SUMMARY OF THE INVENTION

The invention provides a novel method and apparatus for monitoring the frequency of current pulses in an electromagnet during that phase of its operating cycle during which its armature may be assumed to be in engagement with the stator. In accordance with the invention, when the armature is in engagement with the stator, hereinafter referred to as the holding phase, current pulses cycle at a predetermined frequency between upper and lower limits. The limits are maintained, and the frequency compared against a reference frequency, by appropriate circuitry controlling a switching device for connecting or disconnecting the electromagnet with a current source, depending upon whether or not the desired engagement has occurred.

As is well known in the art, owing to the inductance of the electromagnet the current, when switched on, does not increase abruptly, nor does it drop abruptly when switched off. A freewheeling circuit may be provided for maintaining current flow within the coil of the solenoid for a predetermined time after it has been disconnected.

Since the current applied to the coil is controlled to be confined between predetermined upper and lower levels, the resultant pulse frequency may be influenced by several factors such as, for instance, the supply voltage, the temperature of the coil, and the inductance of the electromagnet.

Surprisingly, it has been found that deviations in the pulse frequency resulting from changes in coil temperature or even from deviations in the supply voltage are insignificant, by contrast to frequency deviations caused by significant differences in the inductance of the electromagnet as a result of the engagement of the armature with the stator or its release therefrom.

The invention may be useful for controlling electromagnetically induced movements as well as the subsequent retention of fuel intake or exhaust valves of internal combustion engines, in their terminal positions. As defined above, terminal positions as used herein is intended to refer to open or closed positions of the valves. Failure of the valves to move flawlessly between their terminal positions may result in faulty or no combustion.

It is, therefore, of the utmost importance that faulty valve movement be detected and corrected instantly. Operational parameters such as temperatures deviating vastly during normal engine operation, or changes in the supply voltage traceable to changes in the speed of the engine or to the charge of the battery, have been found to be of little if any influence, so that the method and apparatus of the instant invention will provide for reliable engine performance regardless of these parameters.

In accordance with the invention deviations in the pulse frequency resulting from differences in the inductance are monitored for the purpose of reliably determining whether the armature has in fact been attracted by its stator or not.

More specifically, the pulse frequency is monitored during the holding phase of the electromagnet for the purpose of comparison with a predetermined reference frequency, and a signal is generated if the difference detected exceeds a predetermined maximum.

Advantageously, the signal may be utilized to initiate another energization phase of the electromagnet.

The maximum deviation between the actual current cycling frequency and the reference frequency may be about 20%.

In an advantageous embodiment of the invention, the apparatus may comprise means for comparing the frequency of the holding current pulses in an electromagnet against a reference frequency and for switching on the control circuit for initiating another energization phase where a difference exceeding a predetermined maximum has been measured.

The means for measuring and comparing the frequency may preferably be connected to the output of the control circuit.

DESCRIPTION OF THE DRAWINGS

The novel features which are considered characteristic of the invention are set forth with particularity in the appended claims. The invention itself, however, in respect of its organization as well as its method of operation, together with other objects and advantages thereof will be best understood from the following description of the illustrative embodiment when read in conjunction with the accompanying drawings, in which:

DESCRIPTION OF THE PREFERRED EMBODIMENT

Figure 2:
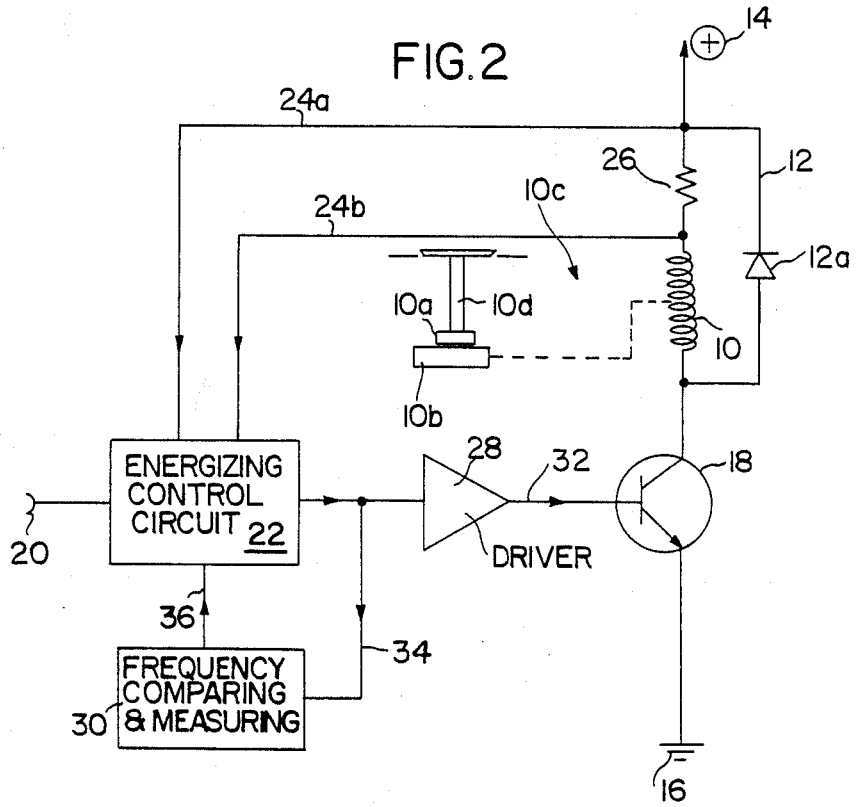
FIG. 2 is a diagram, in block form, of a circuit for practicing the method in accordance with the invention.

The circuit of in FIG. 2 shows an electromagnetic load, for instance a solenoid coil 10 which together with an armature 10*a* and stator 10is part of an electromagnet 10*c* shown schematically for cyclically driving and temporarily retaining a fuel intake or exhaust valve schematically shown at 10*d* in one of its terminal positions. A freewheeling circuit 12 depicted in its simplest form as a diode 12*a* is connected in parallel to the load 10. The diode 12*a* controls the direction of current flowing in the freewheeling circuit 12. The electromagnetic load 10 and its freewheeling circuit 12 are connected between the positive terminal 14 of a voltage source and ground 16.

Whenever a switch such as a transistor 18, is turned on, current may flow through the electromagnet 10 between the voltage supply 14 and ground 16. When the transistor 18 is at times turned off, current flow from the supply 14 is interrupted, but gradually decaying current continues to flow in the electromagnet 10 across its freewheeling circuit 12.

A measuring resistor 26 is provided in the freewheeling circuit 12 and resistor 26 serves to provide signals indicative of the level of current flowing in the freewheeling circuit 12 arrangement. The signals may be fed to a control unit 22 along lines 24*a* and 24*b*. The lines 24*a* and 24*b* respectively lead from two input terminals of the control unit 22 to junctions between the resistor 26 with the voltage source 14 and with the electromagnet 10. As indicated by a further input terminal 20 the control unit 22 may also receive signals from external sources for controlling the transistor 18 in dependence of other engine parameters. This latter aspect forms no part of the present invention and will, therefore, not be described.

Figure 3:
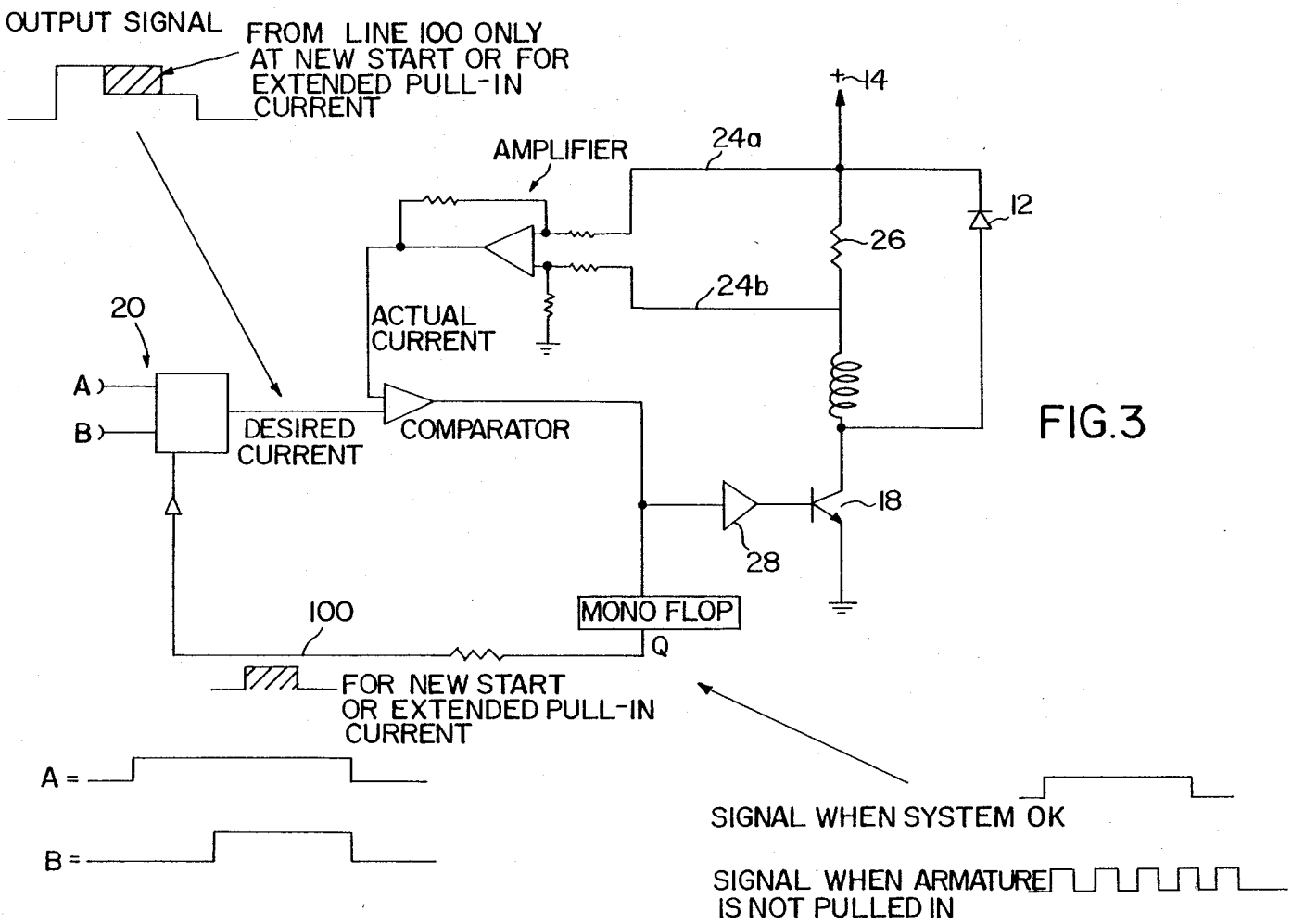
FIG. 3 is a diagram showing details of the control circuit shown in FIG. 2.

As shown in FIG. 3, the control unit 22 may comprise an operational amplifier 80 having its inputs connected to the resistor 26 along lines 24*a* and 24*b*. The output signal of the amplifier 80 is fed to one input of a comparator 82 where it is compared with a reference current of predetermined magnitude. The output of the comparator 82 is in turn connected to a driver stage 28. The driver stage 28 is connected to the base of the transistor 18 and renders it conductive whenever the difference between the signals compared in the comparator 82 exceed a predetermined upper or lower limit.

Figure 1:
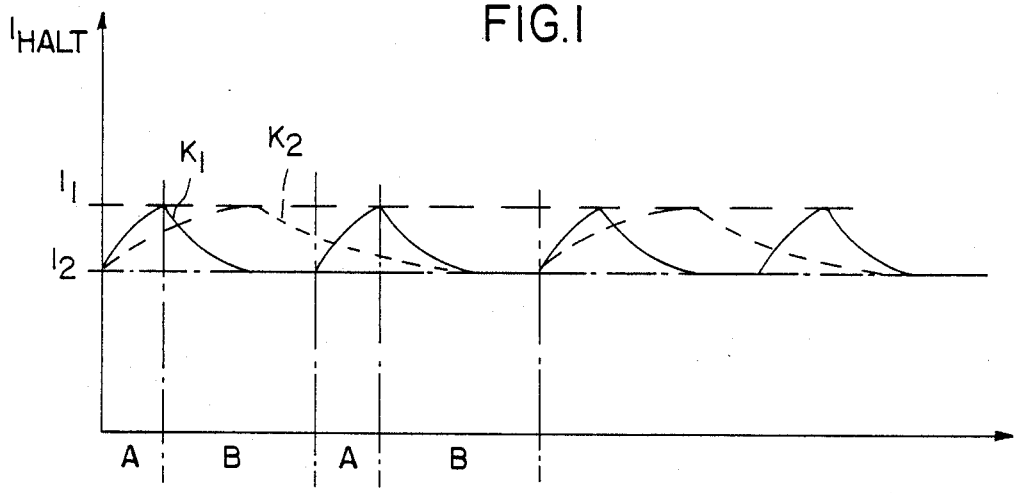
FIG. 1 is a diagram of current pulses for explaining the operation of the present invention.

Reference is now made to FIG. 1 for explaining the principles of the present invention. Once the coil 10 of the electromagnet has been energized by a current of a sufficiently high level $I_{halt}$ to pull the armature into engagement with the stator, it is necessary, in order to maintain the engagement, subsequently to maintain some current flow in the coil 10. Advantageously, this current, hereinafter referred to as the holding current, may be at a level below that of the energizing current. By appropriately turning the transistor 18 on and off, the holding current may cycle between upper and lower limits $I_1$ and $I_2$ considerably below the energizing current level. That is to say, when the desired or reference current applied to one input of the comparator B is below $I_1$ by a predetermined difference, the transistor 18 may be turned off by the control unit 22 to prevent the current from rising further. Thereafter current flowing in the freewheeling circuit 12 decays gradually, the rate of decay being a function of several factors.

As stated above, the factor relevant in the context of the present invention is the inductance of the electromagnet. Other factors affecting the rate of decay may for present purposes be considered sufficiently insignificant to be ignored. For instance, while the supply voltage does indeed influence the rate of current increase in the coil of the electromagnet 10, its effect is limited to portion A of a frequency period which is generally less than 25% of the total duration of the cycle. However, the portion B during which the current is decaying is of substantially longer duration and is a function of the inductance of the electromagnet. Once the current has decayed to lower level $I_2$ which may be lower than the reference current by a predetermined magnitude, the control unit 22, through driver 28, again renders the transistor 18 conductive by applying a signal to its base along a line 32 until the current once again rises to level $I_1$.

The rising portion of the holding current cycle is identified in FIG. 1 by letter A; the decaying portion is identified by letter B. The sum of the intervals A+B constitutes the frequency of a current pulse.

The frequency with which the output condition of the control unit 22 changes is directly related to the frequency of the current cycling between its upper and lower limits $I_1$ and $I_2$ and may be applied, suitably reshaped in a well known manner as a square wave, for instance, to a conventional frequency measuring unit 30 along line 34. The frequency measuring unit 30 may comprise a monoflop or monostable multivibrator and is adapted to compare the square wave signal with a reference frequency. In case the difference measured exceeds a predetermined value the frequency measuring unit 30 may feed a signal to the control component along line 36.

FIG. 1 depicts different frequency curves of current cycling in the electromagnet 10 under conditions when the armature is in engagement with the stator and when it is not. The curves have been designated $K_1$ and $K_2$ and are seen to be noticeably different, depending upon whether the armature is in engagement with the stator or not. The difference in frequency may be as high as 50%. This is a significant value which allows for an easy and reliable determination of whether or not the armature is in engagement with the stator. Preferrably, the apparatus of this invention responds to a frequency difference of about 20%.

If the evaluation of the frequency by the measuring unit 30 indicates that there is no engagement, the signal applied to the control unit 22 along line 36 causes a signal to be fed to the base of the transistor 18 to render it conductive thereby to initiate another energizing phase of the electromagnet 10. The energizing current is of an amplitude sufficiently high to cause the armature to be drawn into engagement with the stator; but the subsequent holding current may be significantly lower, for instance, about 20% of the maximum energizing current.

The method and apparatus for controlling the operation of an electromagnet, by providing a reliable indication of whether or not an armature has been driven into engagement with the stator of an electromagnet are deemed to be of particular advantage in connection with fuel intake and exhaust valves of internal combustion engines. A signal generated when no engagement has been achieved may be utilized to introduce substantially instantaneous remedial action by initiating another energization cycle.

Since certain changes may be made in the described embodiment without departing from the scope of the invention, all matter contained herein shall be interpreted as illustrative and not limiting in any sense.

What is claimed is:

1. A method of controlling the engagement in an electromagnet of an armature with a stator, comprising the steps of:

energizing said electromagnet with high level current to attract the armature into engagement with the stator;

turning off said high level current;

feeding to said electromagnet pulses of lower level current cycling between upper and lower limits sufficient to maintain said engagement;

comparing the frequency of said pulses with a reference frequency;

generating a signal if said pulse frequency differs from said reference frequency by a predetermined value; and reenergizing said electromagnet with high level current in response to said signal.

2. The method of claim 1, wherein said signal is generated if said reference frequency is higher than said pulse frequency.

3. The method of claim 2, wherein said signal is generated if said reference frequency exceeds said pulse frequency by about 20%.

4. An apparatus for controlling the position of an armature relative to its stator in an electromagnet, comprising:

means for selectively energizing said electromagnet with high level current for attracting said armature into engagement with said stator and for thereafter applying to said electromagnet pulses of current cycling between predetermined upper and lower limits below said high level current for maintaining said engagement between said armature and said stator;

means for comparing the frequency of said current pulses with a reference frequency;

means responsive to a predetermined difference between the frequency of said pulses and said reference frequency for generating a signal; and means for causing said energizing means to reenergize said electromagnet with high level current in response to said signal.

5. The apparatus of claim 4, wherein said energizing means is connected to switch means for connecting said electromagnet to a source of high level current.

6. The apparatus of claim 5, wherein said switch means comprises a transistor the base of which is connected to the output means of said energizing means.

7. The apparatus of claim 6, wherein said energizing means renders said transistor conductive when said reference frequency exceeds said pulse frequency.

8. The apparatus of claim 7, wherein said energizing means renders said transistor conductive when said reference frequency exceeds said measured frequency by about 20%.

9. The apparatus of claim 4, wherein said means for comparing is adapted to emit a pulse train of a first pulse width when the frequency of said current pulses substantially corresponds to said reference frequency, and a pulse train of a second pulse width when the frequency of said current pulses differs from said reference frequency.

10. The apparatus of claim 9, wherein said means for comparing is connected to logic means having a first output state in response to said pulse train of said first pulse width and a second output state in response to said pulse train of said second pulse width.

11. The apparatus of claim 10, wherein said logic means comprises monostable vibrator means.

12. The apparatus of claim 11, wherein said monostable vibrator means is connected to said energizing means and said energizing means is adapted to reenergize said electromagnet in response to said second output state.

* * * * *